US009190774B2

(12) United States Patent
De Bruijn et al.

(10) Patent No.: US 9,190,774 B2
(45) Date of Patent: Nov. 17, 2015

(54) CONTACT PIN, HEADER CONNECTOR AND CONNECTOR ASSEMBLY

(75) Inventors: Jeroen De Bruijn, Loon op Zand (NL); Gert Droesbeke, Saint-Vit (FR); Winnie Heyvaert, Brasschaat (BE); Ludwig Lange, Nuland (NL); Stefaan Hendrik Jozef Sercu, Brasschaat (BE)

(73) Assignee: FCI, Guyancourt (FR)

( * ) Notice: Subject to any disclaimer, the term of this patent is extended or adjusted under 35 U.S.C. 154(b) by 194 days.

(21) Appl. No.: 13/994,163

(22) PCT Filed: Dec. 15, 2011

(86) PCT No.: PCT/IB2011/003240

§ 371 (c)(1),
(2), (4) Date: Sep. 3, 2013

(87) PCT Pub. No.: WO2012/080839

PCT Pub. Date: Jun. 21, 2012

(65) Prior Publication Data

US 2013/0344743 A1 Dec. 26, 2013

(30) Foreign Application Priority Data

Dec. 16, 2010 (WO) ..... PCT/IB2010/003522

(51) Int. Cl.

| | |
|---|---|
| ***H01R 13/04*** | (2006.01) |
| ***H01R 13/627*** | (2006.01) |
| ***H01R 13/6471*** | (2011.01) |
| ***H01R 43/00*** | (2006.01) |
| *H01R 43/16* | (2006.01) |

(52) U.S. Cl.

CPC ..... *H01R 13/6278* (2013.01); *H01R 13/04* (2013.01); *H01R 13/6471* (2013.01); *H01R 43/00* (2013.01); *H01R 43/16* (2013.01); *Y10T 29/49204* (2015.01)

(58) Field of Classification Search

CPC ..... H01L 2924/00013; H01L 2924/0002; H01L 2924/00; H01L 2224/29099; H01L 2924/00014; H01L 2924/3011; H01L 2224/2929; H01R 13/62905; H01R 13/62927; H01R 13/62966; H01R 13/62972; H01R 13/633; H01R 13/635

USPC ..... 439/825, 82, 751, 682, 884, 943

See application file for complete search history.

(56) References Cited

U.S. PATENT DOCUMENTS

| | | | | |
|---|---|---|---|---|
| 4,681,392 | A * | 7/1987 | Terita | 439/751 |
| 6,260,268 | B1 | 7/2001 | Gentry | 29/874 |
| 6,808,420 | B2 * | 10/2004 | Whiteman et al. | 439/607.08 |
| 2003/0040227 | A1 * | 2/2003 | Norris | 439/751 |
| 2006/0276081 | A1 | 12/2006 | Cohen et al. | 439/608 |

FOREIGN PATENT DOCUMENTS

| | | | |
|---|---|---|---|
| DE | 10 2008 004 882 | A1 | 7/2009 |
| DE | 20 2009 009 933 | U1 | 10/2009 |
| DE | 20 2009 010 426 | U1 | 11/2009 |

(Continued)

*Primary Examiner* — Abdullah Riyami
*Assistant Examiner* — Nelson R Burgos-Guntin
(74) *Attorney, Agent, or Firm* — Harrington & Smith

(57) ABSTRACT

The invention relates to a contact pin having longitudinal surfaces bulged to define opposite contact lines extending in longitudinal direction of the contact pin, wherein in cross section of the contact pin the plane through the two opposite contact lines is offset from the cross sectional center of the contact pin.

15 Claims, 8 Drawing Sheets

(56) References Cited

FOREIGN PATENT DOCUMENTS

| | | | |
|---|---|---|---|
| EP | 0 077 941 | A1 | 5/1983 |
| EP | 0 492 017 | A1 | 7/1992 |
| EP | 1 049 201 | A1 | 11/2000 |
| EP | 1 388 912 | A1 | 2/2004 |
| EP | 2 099 098 | A1 | 9/2009 |
| GB | 2 248 565 | A | 4/1992 |
| GB | 2 341 280 | A | 3/2000 |

* cited by examiner

CONTACT PIN, HEADER CONNECTOR AND CONNECTOR ASSEMBLY

TECHNICAL FIELD

The present disclosure relates to the field of electrical connector assemblies, to a header connector with one or more contact pins and to a contact pin for such header connectors.

BACKGROUND

With the increasing signalling speed required by present-day systems signals transmitted over a conductor become more and more sensitive to coupling and/or cross talk with neighbouring conductors. Such coupling and/or cross talk interaction between conductors is sensitive to the distance between the conductors. Thus, in order to accurately assess and/or control the amount and/or effect of such interaction on a particular conductor at one or more signal frequencies, the relative positions of the conductors are important.

The geometry of the conductors and their relative position also impacts the impedance of the system and the electric field. To optimize impedance, this impact should be minimized.

Furthermore, since there are continuing desires for miniaturization there is a need to provide connector designs which allow a compact build. Further concerns are cost reduction for materials and manufacturing.

SUMMARY

In a first aspect, the contact pin of claim 1 is provided. The asymmetric position of the contact lines make it possible to use it in combination with a receptacle contact having a U-shaped cross section, wherein the material of the contact pin is more concentrated between the contact lines and the walls of the U-shaped section. It has been found that pin material at the opposite side of the contact lines does not substantially contribute to signal transfer and therefore negatively affects crosstalk and impedance. Improved signal transfer and signal integrity are obtained without affecting mating stability and required insertion force.

In a second aspect a header connector according to claim 2 is provided. The header connector comprises at least one contact pin according to claim 1, typically a plurality of pins arranged in an array or grid of rows and columns.

Impedance can be further improved by a connector according to claim 3.

In a further aspect a connector assembly according to claim 4 is provided with a header connector and a corresponding receptacle connector. The contacts of the receptacle connector and/or the header connector can for instance have opposite terminal ends for mounting on or in a circuit board. Thus, the terminal end can be a "eye-of-the-needle" press fit contacts type or a "surface mount" contact type. The connector assembly may, e.g., be a straight connector, a mezzanine connector, or have an angle between opposite contacts, e.g., a right angle.

In a connector according to claim 5 the contact pin is substantially surrounded by the U-shaped portion of the receptacle contact. This further reduces cross-talk effects and improves impedance by reducing local distortions of electric field lines, which could otherwise be caused by a portion of the relatively narrow and sharp contact pin protruding from the relatively bulky and rounded-off receptacle contact.

Signal transfer and integrity can be further improved with a connector assembly according to claim 6.

A connector according to claim 7 makes use of differential pair technology, which reduces crosstalk and electromagnetic interference, noise emission and noise acceptance. Moreover, it can achieve a constant and known characteristic impedance, allowing impedance matching techniques important in a high-speed signal transmission line or high quality balanced line and balanced circuit audio signal path.

Differential pair technology is further optimized in a connector assembly according to claim 8 or 9. Notwithstanding the different orientation of the contact pins and the receptacle contacts in the ground contacts and signal pairs, the contact lines of these contacts are still coplanar in a connector assembly according to claim 11. This contributes to optimization of the systems impedance.

A connector assembly according to claim 12 and/or 13 allows easier insertion of contact pins of any cross sectional geometry into a corresponding receptacle contact.

The contact pins can advantageously be manufactured in a method according to claim 14, e.g., by punching or stamping. As an alternative, the contact pin may be stamped and the asymmetric bulge may be produced by coining at least a portion of the contact pin in an appropriate shape.

BRIEF DESCRIPTION OF THE DRAWINGS

These and further aspects will hereafter be more fully explained with reference to the drawings showing an embodiment of the invention by way of example.

DETAILED DESCRIPTION OF EMBODIMENTS

Figure 1:
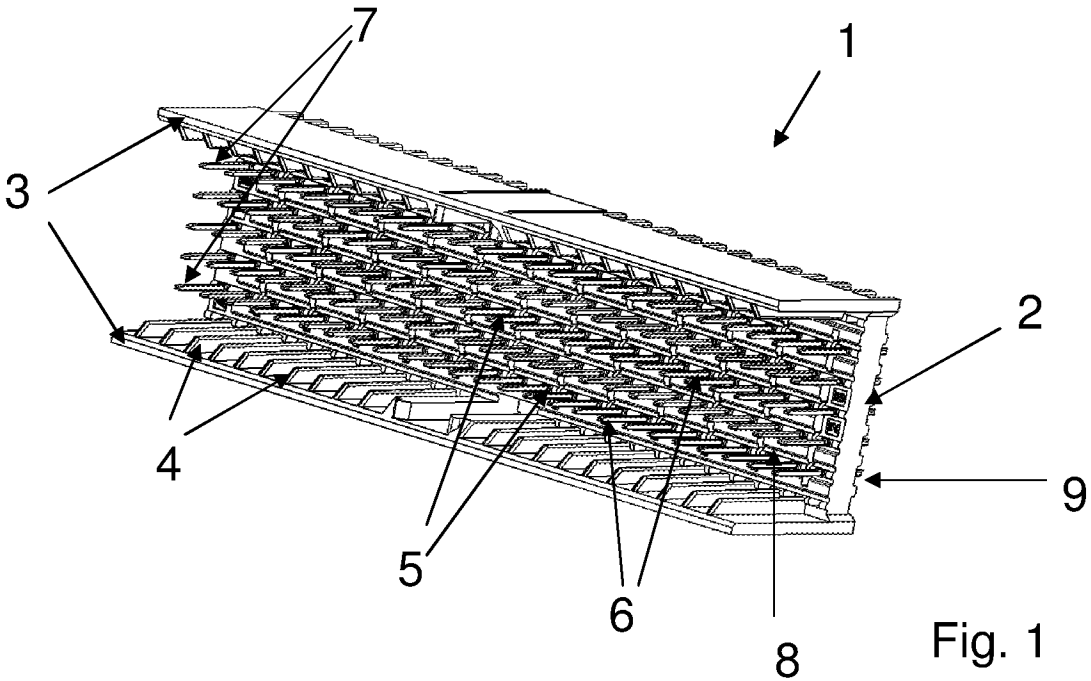
FIG. 1: shows in perspective view an embodiment of a header connector according to the invention.
Figure 3B:
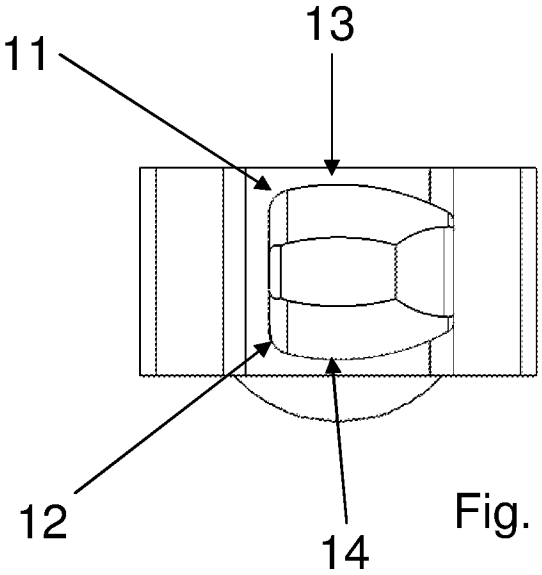
FIG. 3B; shows the contact pin of FIG. 3A in front view.
Figure 3A:
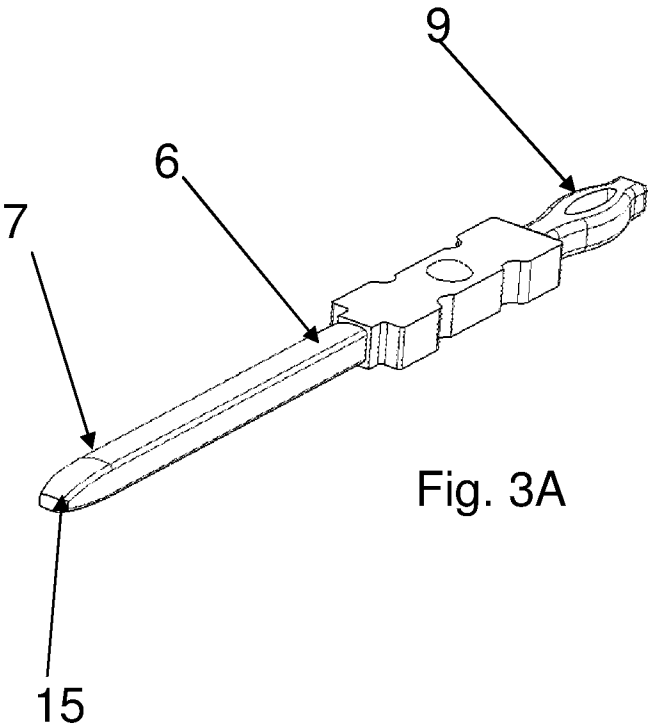
FIG. 3A: shows in perspective view a contact pin of the header connector of FIG. 1.

FIG. 1 shows a header connector 1 comprising a base plate 2 and two sidewalls 3 reinforced by ribs 4. The base plate 2 is provided with a grid-like array of columns and rows of contact openings 5 each accommodating a contact pin 6. A contact pin 6 is shown in more detail in FIG. 3. The contact pins 6 comprise a first terminal end 7 extending from a mating surface 8 for cooperation with a receptacle contact described hereinafter, and a second terminal end 9 which in the shown embodiment is an eye-of-the-needle press fit contact for circuit board mounting. Between the two terminal ends 7, 9 the contact pin 6 comprises a profiled middle section 10 moulded into the base plate 2. As shown in more detail in FIGS. 3A and 3B, the contact pins 6 have two opposite contact faces 11, 12 bulging to form contact lines 13, 14 indicated by an interrupted line in the drawing of FIG. 3A. To allow easier insertion of the contact pin 6 into a receptacle the first terminal end 7 comprises a tapered outer end 15 which gradually narrows down.

Figure 2:
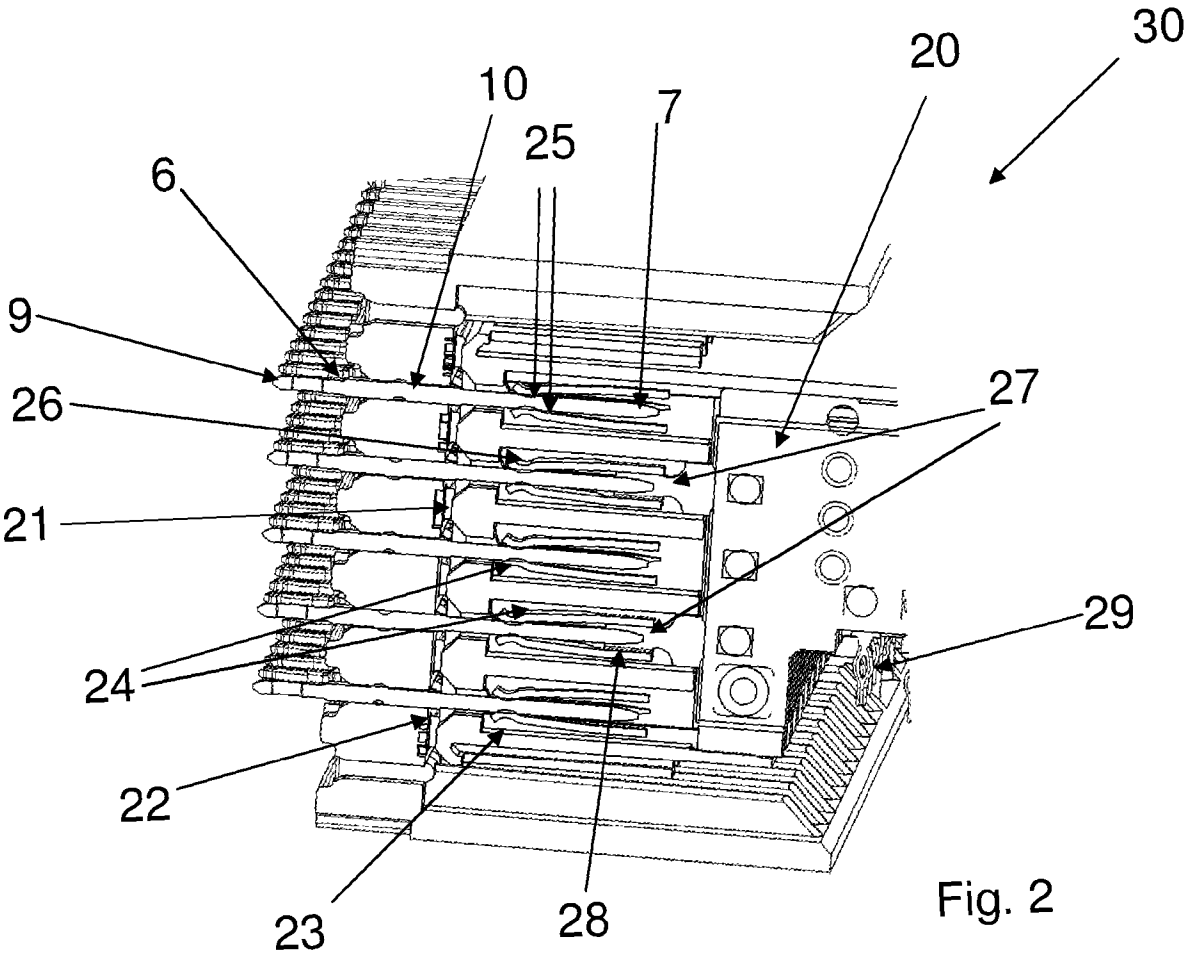
FIG. 2: shows in perspective cross section a connector assembly of a receptacle connector with the header connector of FIG. 1.

In FIG. 2 the header connector 1 is shown in perspective cross section, while the header connector 1 is in mating contact with a receptacle connector 20. The receptacle connector 20 comprises a housing with a mating face 21 and openings 22 each allowing access to a cavity 23 accommodating a receptacle contact 24. The receptacle contacts 24 each comprise two resilient contact beams 25 slightly inclining towards each other in the direction of the openings 21. The outer ends 26 of the beams 25 close to the opening 21 are curved towards each other to provide a tight resilient grip for an inserted contact pin. The other ends of the beams 25 are bridged by a back 27 to form a U-shaped section 28. The back 27 extends in a direction opposite to the beams 25 towards a second terminal end 29. Such receptacle contacts may for instance be manufactured by stamping or punching a blank and bending, possibly also including a coining step. In the embodiment shown in the drawings the terminal end 29 is under right angles with the contact beams 25 and is shaped as an eye-of-the-needle press fit contact for circuit board mounting. This way the receptacle connector 20 and the header connector 1 form a connector assembly 30 for connecting two circuit boards under right angles. In alternative embodiments different angles are conceivable.

Figure 4:
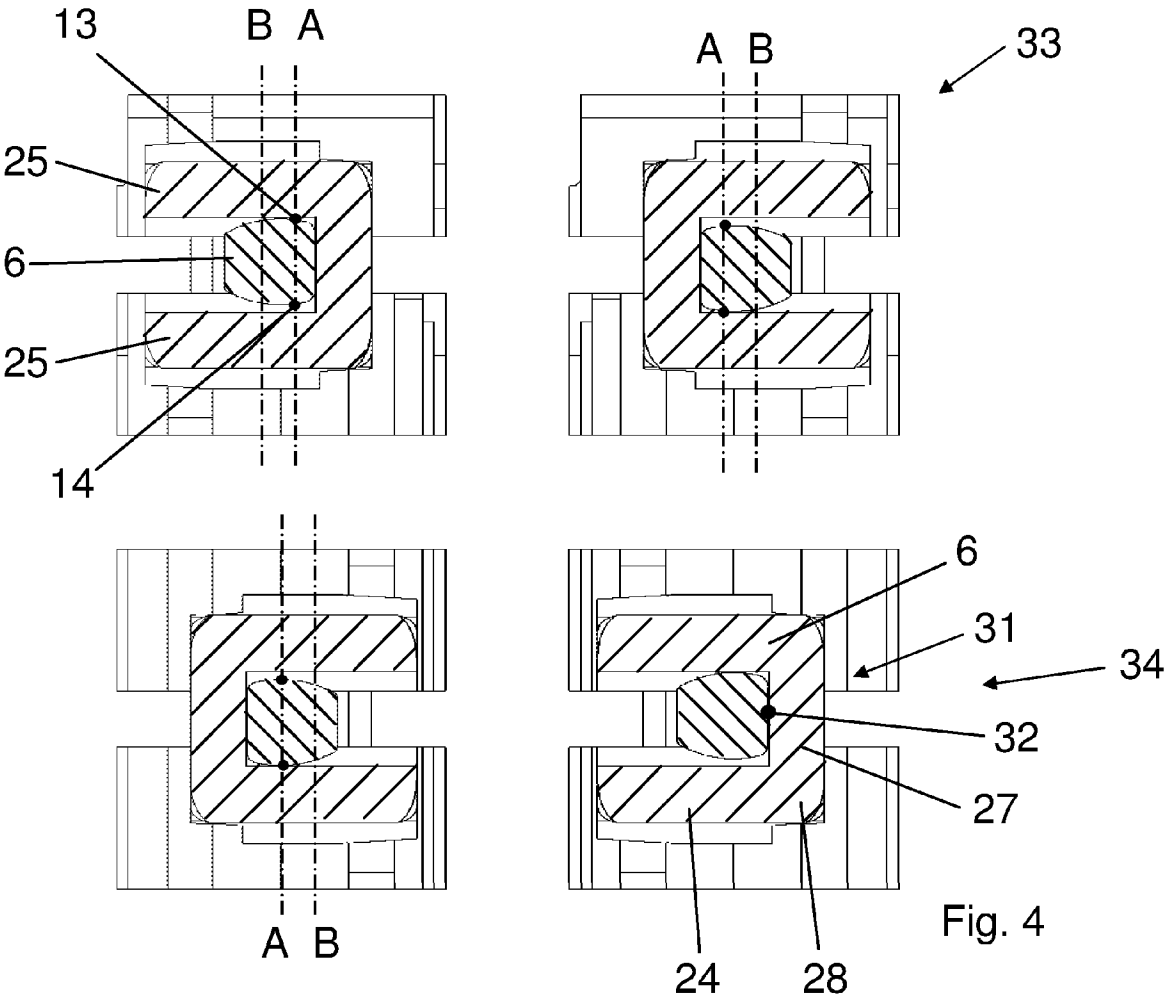
FIG. 4: shows a signal pair and a ground pair of the connector assembly of FIG. 2.

FIG. 4 shows a group of four contact pins 6 inserted in four respective receptacle contacts 24. In the drawing line A represents the plane through the contact lines 13, 14, whereas line B represents a vertical plane through the center line of the receptacle contact 24. Plane A through the contact lines 13, 14 is located between the vertical center face B of the contact pin 6 and the back 27 of the U-shaped section 28 of the receptacle contact 24.

The contact pins 6 have a side face 31 facing the back 27 of the U-shaped section 28 of the receptacle contact 24. The side face 31 bulges towards the back 27 to form a third contact line 32. Here the width of the contact beams 25 is about two times larger than the width of the contact pin 6.

Figure 5:
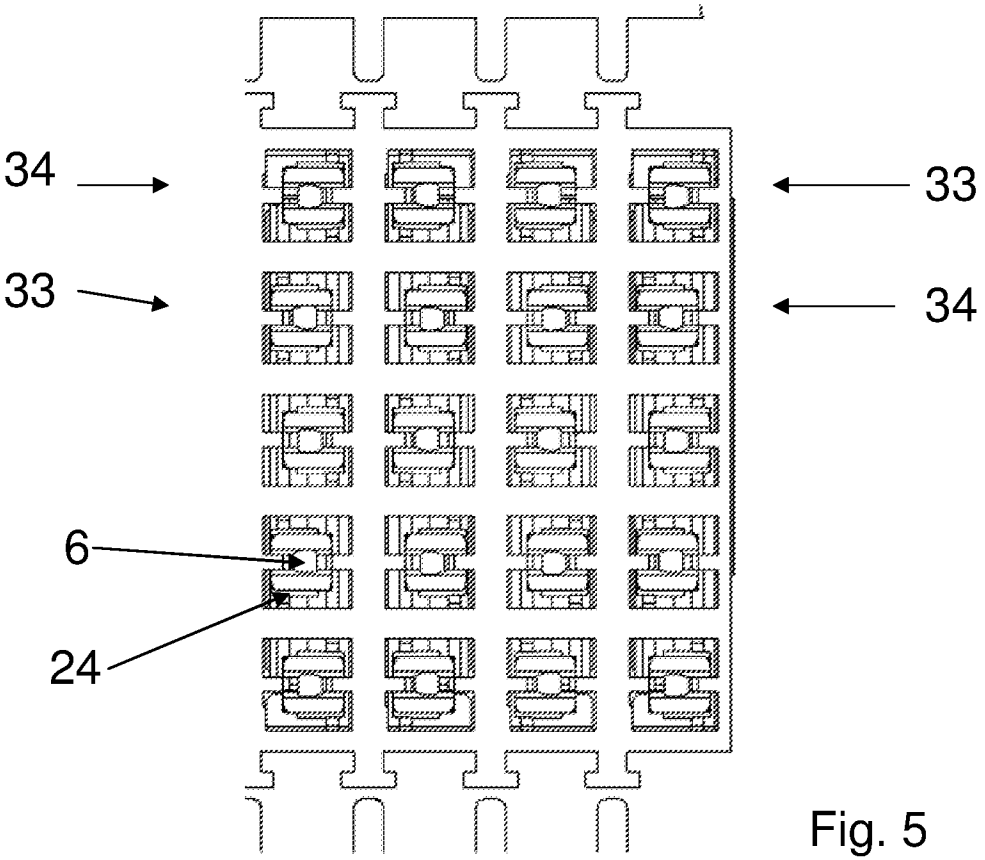
FIG. 5: shows a configuration of differential pairs of the connector assembly of FIG. 2.

The contacts 6, 24 in FIG. 4 are arranged to form a differential signal pair 33 and a pair 34 of ground contacts. With the signal pair 33 the backs 27 of the respective receptacle contacts 24 are turned towards each other so the distance between the conductive parts of the contacts 6, 24 is minimized. The backs 27 of the respective receptacle contacts 24 of the ground pair 34 are turned away from each other. The orientation of the corresponding contact pins 6 alternates correspondingly, so the face A through the contact lines 13, 14 is always between the back 27 and the vertical center face B of the contact pin 6. The contact pins 6 and the thickness of the back 27 are configured in such a way that the contact lines 13, 14 of the signal pairs 33 in a column are always coplanar with the contact lines 13, 14 of the ground pairs 34 and the other signal pairs 33. In each column and row of the connector assembly signal pairs 33 and ground pairs 34 are arranged in an alternating pattern, as shown in FIG. 5. This way each signal pair 33 is effectively shielded by surrounding ground pairs 34. Within the columns the contact lines 13, 14 of all contact pins 6 are coplanar, whereas the cross sectional centre of the contact pins 6 is alternatingly at the left side or at the right side from the contact lines 13, 14.

Figure 6:
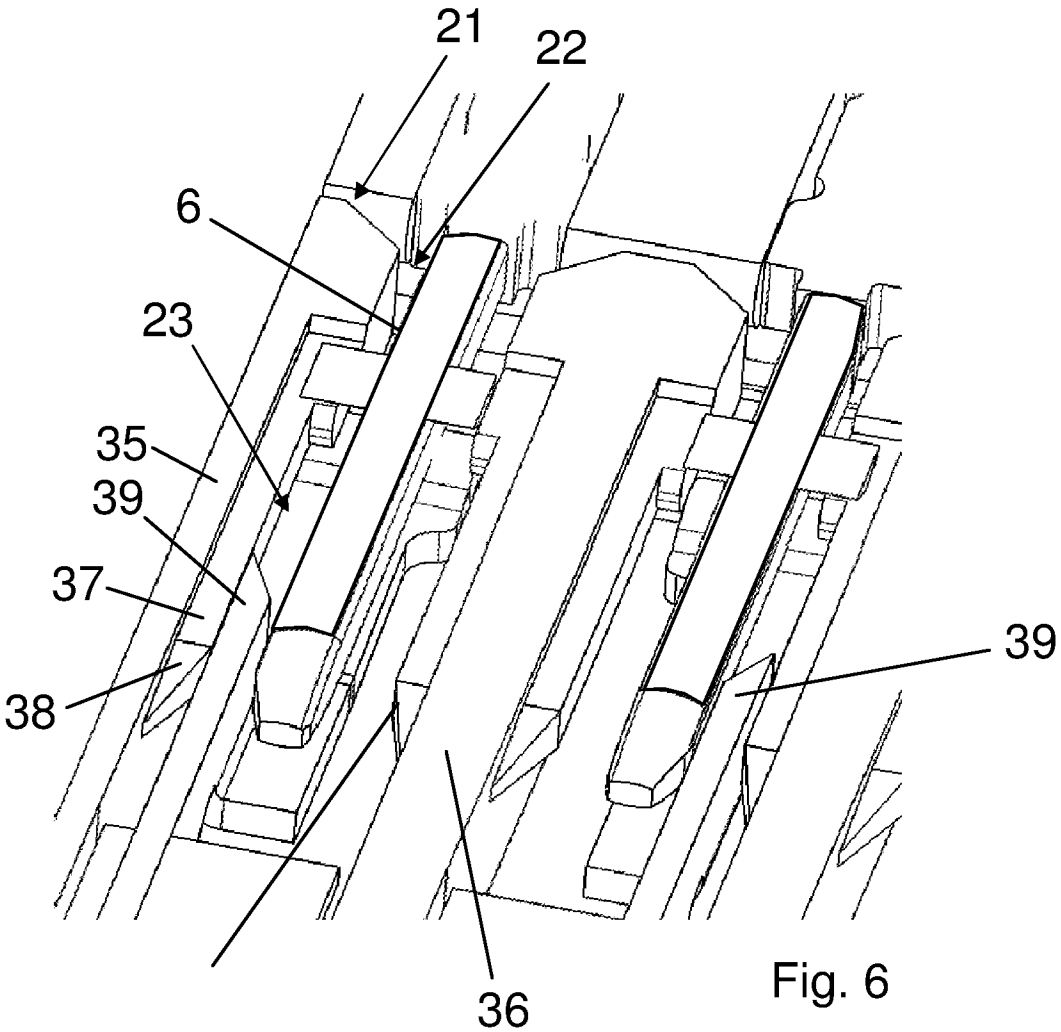
FIG. 6: shows in perspective view a detail of the connector assembly of FIG. 2.

As shown in FIG. 6, each cavity 23 in the receptacle connector 20 is provided with side walls 35, 36 with a rib extending in a direction parallel to the longitudinal direction of the cavity 23. The rib 37 comprises a lead-in portion 38. The rib 37 serves to establish the position of the contact beams 25 within the cavity 23 and to keep the contact beams 25 separated from the side walls 35, 36. To allow easier insertion of the contact pin 6 the back 27 of the U-shaped section 28 of the receptacle contact 24 comprises an inwardly chamfered edge 39 directed towards the opening 22 in the mating surface 21.

Figure 7:
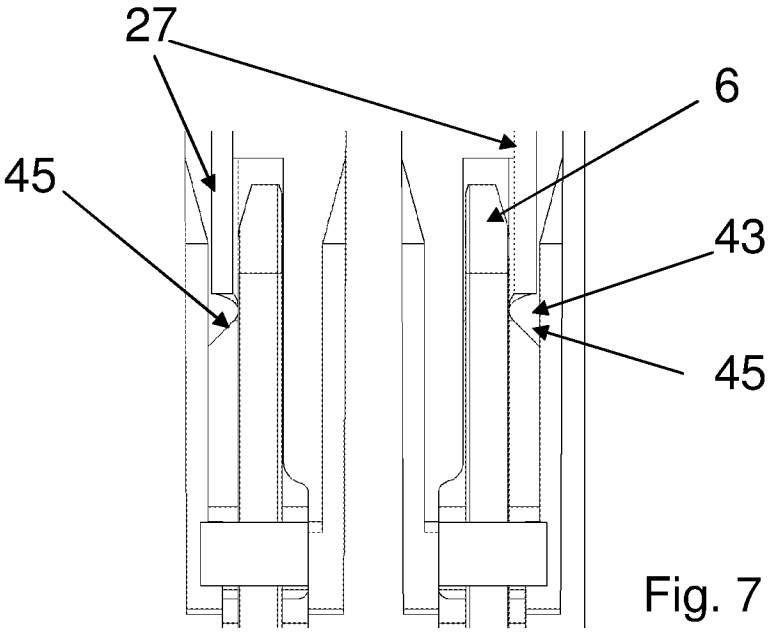
FIG. 7: shows a detail of an alternative embodiment of a connector assembly according to the invention.

To allow easier insertion further, or alternatively, a protruding portion 43 is provided at the side wall of the cavity, as shown in FIG. 7. The protruding portion 43 is arranged in front the back 27 of the receptacle contacts 24 towards the receptacle mating surface 21. The portion 43 comprises an inwardly chamfered edge 45 directed towards the opening 22 in the mating surface 21 and overlapping at least part of the back 27 of the respective receptacle contacts 24.

Figure 8:
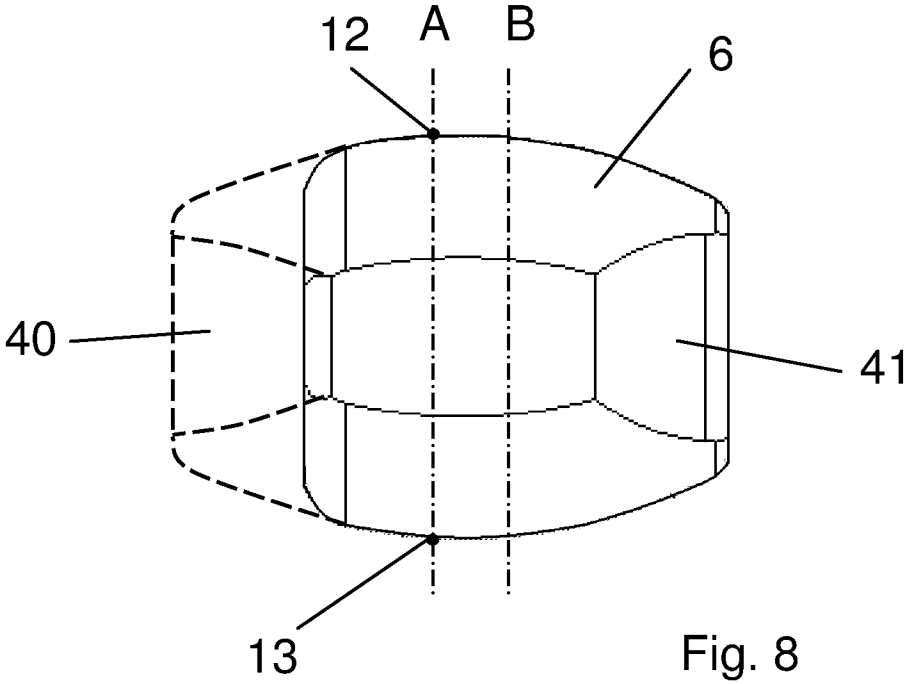
FIG. 8: shows in front view two stages of manufacturing of the contact pin of FIGS. 3A and 3B.

FIG. 8 shows a method for manufacturing a contact pin 6. The tip of the contact pin 6 is shown in front view. The contact pin 6 can be manufactured by first manufacturing a regular symmetrical pin having the contact lines 13, 14 in its vertical center plane. In a next step a portion 40 of the pin can be removed along a cutting plane parallel but offset to the plane A through the contact lines 13, 14. In the drawing of FIG. 8 the portion 40 is indicated by dotted lines. The opposite side 41 remains intact. This way, the vertical center plane of the contact pin 6 is shifted towards intact side 41 and the plane A through the contact lines 13, 14 becomes offset from the new vertical center plane B.

The invention claimed is:

1. Contact pin having longitudinal surfaces bulged to define opposite contact lines extending in longitudinal direction of the contact pin, wherein a material of the contact pin extends between the bulged longitudinal surfaces without a gap therebetween, and wherein in cross section of the contact pin the plane through the two opposite contact lines is offset from the cross sectional centre of the contact pin.

2. A header connector comprising a housing and one or more contact pins, the one or more contact pins having longitudinal surfaces bulged to define opposite contact lines extending in longitudinal direction of the contact pin, wherein a material of the contact in extends between the bulged longitudinal surfaces without a gap therebetween, and wherein the plane through the two opposite contact lines is offset from the cross sectional centre of the contact pin.

3. The header connector according to claim 2 comprising at least one column of contact pins wherein the contact lines of at least a part of the contact pins are coplanar.

4. A connector assembly comprising a receptacle connector and a header connector, wherein the receptacle connector comprises a mating surface with openings allowing access to receptacle contacts, wherein each receptacle contact has resilient contact beams having free ends near the respective opening, the opposite ends being bridged by a back to form a U-shaped cross section; and wherein the header connector comprises contact pins, having longitudinal surfaces bulged to define opposite contact lines extending in longitudinal direction of the contact pin, wherein a material of the contact pin extends between the bulged longitudinal surfaces without therebetween, and wherein in cross section of the contact pin the plane through the two opposite contact lines is between the cross sectional centre of the contact pin and the back of the receptacle contact.

5. The connector assembly according to claim 4 wherein the contact beams of the one or more receptacle contacts have a width which is larger than the width of the one or more contact pins.

6. The connector according to claim 4 wherein at least a part of the contact pins are shaped to form a third contact line contacting the back of the receptacle contact.

7. The connector assembly according to claim 4 wherein the contact pins of the header connector and the receptacle contacts of the receptacle connector are arranged to form one or more differential pairs wherein in each pair the contact pin and receptacle contact of one contact mirrors the contact pin and receptacle contact of the other contact.

8. The connector assembly according to claim 7 wherein the differential pairs contain signal pairs having the two receptacle contacts arranged back-to-back, shielded by ground pairs comprising two receptacle contacts arranged with the contact beams pointing to each other in cross section.

9. The connector assembly according to claim 8 comprising rows and columns of alternating ground and signal pairs.

10. The connector assembly according to claim 8 wherein the contact lines of the contact pins and the back of the receptacle contact are configured in such a way that the contact lines of the signal pairs in a column are coplanar with the contact lines of the ground pairs in the column.

11. The connector assembly according to claim 4 wherein the back of at least a part of the receptacle contacts comprises an inwardly chamfered edge directed towards the receptacle mating surface.

12. The connector assembly according to claim 4 wherein the housing comprises a portion arranged in front of at least a part of the receptacle contacts towards the receptacle mating surface, comprising an inwardly chamfered edge directed towards the receptacle mating surface and overlapping at least part of the back of the respective receptacle contacts.

13. Method of manufacturing a contact pin according to claim 1 wherein the contact pin is first provided with a symmetrical cross section and subsequently a side part of the contact pin is removed along a cutting plane parallel to the plane through the contact lines.

14. The contact pin according to claim 1 wherein the contact pin further comprises a side face, wherein the side face is configured to bulge to form a third contact line.

15. The connector according to claim 4 wherein each on the contact pins further comprise a side face, wherein the side face is configured to bulge to form a third contact line contacting the back of the receptacle contact.

* * * * *